US006569909B1

(12) United States Patent
O'Reilly et al.

(10) Patent No.: US 6,569,909 B1
(45) Date of Patent: May 27, 2003

(54) INHIBITION OF BIOLOGICAL DEGRADATION IN FISCHER-TROPSCH PRODUCTS

(75) Inventors: Kirk T. O'Reilly, El Sobrante, CA (US); Michael E. Moir, San Rafael, CA (US); Dennis J. O'Rear, Petaluma, CA (US)

(73) Assignee: Chervon U.S.A., Inc., San Ramon, CA (US)

( * ) Notice: Subject to any disclaimer, the term of this patent is extended or adjusted under 35 U.S.C. 154(b) by 35 days.

(21) Appl. No.: 09/982,714

(22) Filed: Oct. 18, 2001

(51) Int. Cl.[7] ..... C07C 27/00; C10L 1/32; C02F 1/68; C12N 1/30

(52) U.S. Cl. ..... 518/700; 44/301; 210/764; 435/249

(58) Field of Search ..... 518/700; 44/301; 435/249; 210/764

(56) References Cited

U.S. PATENT DOCUMENTS

| | | | |
|---|---|---|---|
| 3,393,058 | A | 7/1968 | Oppermann |
| 4,086,066 | A | 4/1978 | McDermott |
| 4,188,380 | A | 2/1980 | Oswald |
| 4,568,663 | A | 2/1986 | Mauldin |
| 4,853,140 | A | 8/1989 | Payne et al. |
| 4,867,757 | A | 9/1989 | Payne |
| 5,055,325 | A | 10/1991 | Trivett |
| 5,382,739 | A | 1/1995 | Atkins et al. |
| 5,416,210 | A | 5/1995 | Sherba et al. |
| 5,433,863 | A | 7/1995 | Braden et al. |
| 6,059,955 | A | 5/2000 | Cody et al. |
| 6,069,142 | A | 5/2000 | Gaffney et al. |

FOREIGN PATENT DOCUMENTS

| | | | |
|---|---|---|---|
| EP | 0609079 | A1 | 8/1994 |
| EP | 0921184 | A1 | 6/1999 |
| WO | 00/20534 | A1 | 4/2000 |

OTHER PUBLICATIONS

U.S. patent application Ser. No. 09/982,701, O'Reilly, et al., *Deactivatable Biocides in Ballast Water*, Filed on Oct. 18, 2001.

U.S. patent application Ser. No. 09/982,702, O'Reilly, et al., *Process for Disposing Biocide–Containing Cooling Water*, Filed on Oct. 18, 2001.

U.S. patent application Ser. No. 09/982,699, O'Reilly, et al., *Deactivatable Biocides for Hydrocarbonaceous Producsts*, Filed on Oct. 18, 2001.

Bolch, C.J., et al., *Chemical and Physical Treatment Options to Kill Toxic Dinoflagellate Cysts in Ships' Ballast Water, J. Marine Env. Engg.*, vol. 1, 1993, pp. 23–29, Gordon and Breach Science Publishers, US.

Carey, F.A., et al., *Advanced Organic Chemistry, Chapter 2: Reactions of Carbon Nucleophiles with Carbonyl Groups The Mannich Reaction*, 2nd edition, 1983, pp. 59–62. Plenum Press, New York.

Carlton, J.T., et al., *Shipping Study: The Role of Shipping in the Introduction of Nonindigenous Aquatic Organisms to the Coastal Waters of the United States (other than the Great Lakes) and an Analysis of Control Options, The National Sea Grant College Program/Connecticutt Sea Grant Project R/ES–6*, Report No. CG–D–11–95, Apr. 1995, National Technical Information Service, Springfield, VA.

De Montellano, P.R., et al., *Self–catalyzed Inactivation of Hepatic Cytochrome P–450 by Ethynyl, The Journal of Biological Chemistry*, vol. 255, No. 12, Jun. 25, 1980, pp. 5578–5585, American Society for Biochemistry and Molecular Biology, Baltimore, MD.

De Montellano, P.R., *Alkenes, and Alkynes, Bioactivation of Foreign Compounds*, Chapter 5, 1985, pp. 121–155, Academic Press, Inc., New York.

*Global spread of microorganisms by ships, Brief Communications*, Nature, Nov. 2, 2000.

Grab, L.A., et al., *Comparative Biocidal Efficacy vs Sulfate–Reducing Bacteria, Materials Performance*, vol. 32, No. 6, 1993, pp. 59–62, National Association of Corrosion Engineers, Houston, TX.

Hudgins, C.M., Jr., *Chemical Treatments and Usage in Offshore Oil and Gas Production Systems, Journal of Petroleum Technology*, vol. 44, No. 5, May 1992, pp. 604–611, Society of Petroleum Engineers, Richardson, TX.

Hyman, M.R., et al., *Acetylene Inhibion of Metalloenzymes, Analytical Biochemistry*, vol. 173, No. 2, 1988, pp. 207–220, Academic Press, Inc., New York.

Leung, Hon–Wing, *Ecotoxicology of Glutaraldehyde: Review of Environmental Fate and Effects Studies, Ecotoxicology and Environmental Safety*, 49, 26–39, 2001, Section B, pp. 26–39, Academic Press.

*Methods for Measuring the Acute Toxicity of Effluents and Receiving Waters to Freshwater and Marine Organisms*, 4th Edition, EPA/600/4–90/027F, Aug. 1993, United States Environmental Protection Agency, Reproduced by: National Technical Information Service, U.S. Dept. of Commerce, Springfield, VA.

Morrison, R.T., et al., *Organic Chemistry*, 2nd edition, 1966, pp. 631–632, Allyn and Bacon, Inc., Boston.

(List continued on next page.)

*Primary Examiner*—J. Parsa
(74) *Attorney, Agent, or Firm*—Burns, Doane, Swecker & Mathis, L.L.P.

(57) ABSTRACT

The present invention relates to methods of inhibiting growth and reproduction of microorganisms in rapidly biodegradable hydrocarbonaceous products, containing minor amounts of aqueous liquids. The present invention also relates to rapidly biodegradable hydrocarbonaceous products containing an effective amount of a petroleum-derived hydrocarbonaceous product such that the rapidly biodegradable hydrocarbonaceous product resists visible growth of microorganisms.

16 Claims, No Drawings

OTHER PUBLICATIONS

Roets, Piet, et al., *Stability and Handling of SASOL Semi –Synthetic Jet Fuel, 6th International Conference on Stability and Handling of Liquid Fuels*, Vancouver, B.C., Canada, Oct. 13–17, 1997, pp 789–804, Publisher National Technical Information Services, Springfield, Virginia.

Prior, S.D., et al., *Acetylene as a suicide substrate and active site probe for methane monooxygenase from Methyloccoccus capsulatus* (*Bath*), *Federation of European Microbiological Societies: Microbiology Letters*, vol. 29, 1985, pp. 105–109, Elsevier/North Holland, Amsterdam.

Stirling, D.I., et al., *Effect of Metal–Binding Agents and Other Compounds on Methane Oxidation by Two Strains of Methyloccoccus capsulatus, Archives of Microbiology*, vol. 114, 1977, pp. 71–76, Springer–Verlag.

Yam, P., *Life out of Ballast, Scientific American*, vol. 284, No. 1, Jan. 2001, p. 27, Published by Scientific American, New York, New York.

Yeager, C.M., et al., *Inactivation of Toluene 2–Monooxygenase in Burkholderia cepacia G4 by Alkynes, Applied & Environmental Microbiology*, vol. 65, No. 2, Feb. 1999, pp. 632–639, American Society for Microbiology.

INHIBITION OF BIOLOGICAL DEGRADATION IN FISCHER-TROPSCH PRODUCTS

FIELD OF THE INVENTION

The present invention relates to methods of inhibiting growth and reproduction of microorganisms in rapidly biodegradable hydrocarbonaceous products, containing minor amounts of aqueous liquids. The present invention also relates to rapidly biodegradable hydrocarbonaceous products containing an effective amount of a petroleum-derived hydrocarbonaceous product such that the rapidly biodegradable hydrocarbonaceous product resists visible growth of microorganisms.

BACKGROUND OF THE INVENTION

Certain microbiological problems may arise with respect to the storage and transportation of hydrocarbonaceous products. Hydrocarbons can act as a nutrient for microorganisms; therefore, hydrocarbonaceous products (i.e., fuels such as jet fuel, diesel fuel, naphtha; lubes, and solvents) can be attacked by microorganisms. Microorganisms can slowly grow at the boundary layers of the hydrocarbonaceous product and air, and can grow more rapidly if the hydrocarbonaceous product is also exposed to a layer of water.

Hydrocarbonaceous products are frequently exposed to a layer of water when stored in large storage vessels, such as storage tanks, fuel tanks of aircraft and holds of tankers. In these large storage vessels, water invariably forms due to condensation or it is initially present in the stored hydrocarbonaceous product and slowly separates therefrom. This water gradually forms a layer in the bottom of the storage vessels. The water layer forms an interface with the hydrocarbonaceous product, and becomes a breeding ground for a wide variety of microorganisms. These microorganisms utilize the hydrocarbonaceous product as a nutrient and can multiply.

Eventually the microorganisms can consume a large portion of the hydrocarbonaceous product. The extent to which the microorganisms consume the product is known as the extent of biodegradation, or the biodegradability of the product.

The microorganisms or microbes will grow mostly in the water phase, but when the hydrocarbonaceous product is disturbed during pumping or mixing, the microbes can be dispersed into the hydrocarbonaceous product and cause contamination. When present in the hydrocarbonaceous product, microbial growth can present a problem for several reasons. For example, hydrocarbonaceous products may become contaminated with microbes during storage or shipment and as a result of the microbes, become hazy or cloudy. The growing microorganisms may form sludge in the contaminated hydrocarbonaceous product. When contaminated hydrocarbonaceous products are used in an engine or equipment, the microbes and/or the sludge may decrease the efficiency of the engine or equipment or prevent it from functioning altogether, for example, by plugging filters. In addition, growth of microorganisms, in particular anaerobic sulfate reducing bacteria, in hydrocarbonaceous products during storage or transport may create corrosive sulfur-containing acids and damage the vessels in which the products are contained. This corrosion damage may lead to the need for eventual replacement of these large, expensive vessels.

Further, transport of hydrocarbonaceous products and/or a water layer contaminated with microbes creates a dispersal mechanism for human pathogens, waterborne diseases of plants and animals, and foreign organisms into the environment. For example, infectious bacteria such as cholera have been found in ballast water from marine tankers ("Global Spread of Microorganisms By Ships," *Brief Communications* Nov. 2, 2000 issue of Nature). These infectious organisms can create both a human health problem, and a health problem to native species in the receiving country. Water can also be the vehicle for the introduction of foreign higher life forms into the receiving countries' environment. By this route, Zebra clams are believed to have been introduced into the San Francisco Bay region.

There is a need for hydrocarbonaceous products comprising rapidly biodegradable hydrocarbonaceous products that are capable of resisting visible growth of microorganisms and methods of inhibiting the growth and reproduction of microorganisms in rapidly biodegradable hydrocarbonaceous products, containing minor amounts of aqueous liquids.

SUMMARY OF THE INVENTION

The invention relates to hydrocarbonaceous products comprising rapidly biodegradable hydrocarbonaceous products that are capable of resisting visible growth of microorganisms. One aspect of the present invention is a hydrocarbonaceous product comprising: a) a rapidly biodegradable hydrocarbonaceous product; and b) an effective amount of a petroleum-derived hydrocarbonaceous product such that the resulting hydrocarbonaceous product resists visible growth of microorganisms for at least 10 days under ambient conditions when exposed to a certified inoculant. The rapidly biodegradable hydrocarbon product may include, for example, a Fischer-Tropsch derived liquid product or a low aromatics diesel fuel. When the rapidly biodegradable product is a Fischer-Tropsch derived liquid product, the Fischer-Tropsch product preferably may be one that has a branching index of less than five.

An additional aspect of the present invention is a method of inhibiting growth and reproduction of microorganisms in rapidly biodegradable hydrocarbonaceous products, containing minor amounts of aqueous liquids. The method comprises:

a) providing a rapidly biodegradable hydrocarbonaceous product;

b) adding an effective amount of a petroleum-derived hydrocarbonaceous product to resist visible growth of microorganisms for at least 10 days under ambient conditions when exposed to a certified inoculant; and c) mixing the petroleum-derived hydrocarbonaceous product into the rapidly biodegradable hydrocarbonaceous product.

The method may also comprise the step of processing the mixture with hydrogen (i.e., hydrotreating, hydrocracking, and hydroisomerization) to remove sulfur and other impurities that originate from the conventional fuel component after the period in which growth is expected.

Definitions

Unless otherwise stated, the following terms used in the specification and claims have the meanings given below:

"Biocides" mean chemical compounds that kill or inhibit the growth of microorganisms, such as for example, bacteria, molds, slimes, fungi, and the like.

"Branching index" means a numerical index for measuring the average number of side chains attached to a main chain of a compound. For example, a compound that has a branching index of two means a compound having a straight chain main chain with an average of approximately two side chains attached thereto. The branching index of a product of the present invention may be determined as follows. The total number of carbon atoms per molecule is determined. A preferred method for making this determination is to estimate the total number of carbon atoms from the molecular weight. A preferred method for determining the molecular weight is Vapor Pressure Osmometry following ASTM D-2503, provided that the vapor pressure of the sample inside the Osmometer at 45° C. is less than the vapor pressure of toluene. For samples with vapor pressures greater than toluene, the molecular weight is preferably measured by benzene freezing point depression. Commercial instruments to measure molecular weight by freezing point depression are manufactured by Knauer. ASTM D-2889 may be used to determine vapor pressure. Alternatively, molecular weight may be determined from an ASTM D-2887 or ASTM D-86 distillation by correlations which compare the boiling points of known n-paraffin standards.

"Fischer-Tropsch derived liquid products mean hydrocarbonaceous, liquid products derived from a Fischer-Tropsch process. Fischer-Tropsch derived liquid products include, for example, Fischer-Tropsch naphtha, Fischer-Tropsch jet fuel, Fischer-Tropsch diesel fuel, Fischer-Tropsch solvent, Fischer-Tropsch lube base stock, Fischer-Tropsch lube base oil, Fischer-Tropsch lube base oil feedstock and mixtures thereof.

"Hydrocarbonaceous" means containing hydrogen and carbon atoms and potentially also containing heteroatoms, such as oxygen, sulfur, nitrogen, and the like.

"Hydrocarbonaceous Product" means any hydrocarbonaceous product, including both conventional or petroleum-derived hydrocarbonacous products and those identified as rapidly biodegradable hydrocarbonaceous products. Hydrocarbonaceous products contain hydrogen and carbon atoms and may also contain heteroatoms, such as oxygen, sulfur, nitrogen, and the like.

"Paraffin" means any saturated hydrocarbon compound, i.e., an alkane with a chemical formula of $C_nH_{2n+2}$.

"Petroleum-Derived Hydrocarbonaceous Product" means any hydrocarbonaceous product that is derived from conventional petroleum products and that exhibits virtually no visual growth of microorganisms in approximately ten days or less. Petroleum-derived hydrocarbonaceous products may be derived from, for example, conventional petroleum, conventional diesel fuel, conventional solvent, conventional jet fuel, conventional naphtha, conventional lube base stock, conventional lube base oil, lube base oil feedstock and mixtures thereof.

"Rapidly Biodegradable Hydrocarbonaceous Product" means a hydrocarbonaceous product in which visual growth of microorganisms occurs in approximately ten days or less. Rapidly biodegradable hydrocarbonaceous products may include, for example, Fischer-Tropsch derived liquid products and low aromatics diesel fuel. Rapidly biodegradable hydrocarbonaceous products of the present invention preferably are Fischer-Tropsch derived liquid products.

DETAILED DESCRIPTION OF ILLUSTRATIVE EMBODIMENTS

Hydrocarbonaceous products are typically stored or transported for a period of time before use, generally at least ten days. During storage and/or transport, minor amounts of aqueous liquids invariably form due to condensation or are initially present in the stored hydrocarbonaceous product and slowly separate therefrom. Minor amounts of aqueous liquids typically include between 0.01% and 25% aqueous liquid.

While high levels of biodegradability are ultimately desirable for hydrocarbonaceous products, rapid biodegradation during storage and transport is not desirable. Biodegradation during transport and storage and prior to use may cause many problems, as described previously.

Certain hydrocarbonaceous products now have been identified that not only are subject to biodegradation, but are also subject to rapid biodegradation. These "rapidly biodegradable hydrocarbonaceous products" may show visual growth of microorganisms in approximately ten days or less. The unusual speed of biodegradation of these certain hydrocarbonaceous products has not previously been recognized.

Products identified as rapidly biodegradable hydrocarbonaceous products in the present invention may include, for example, Fischer-Tropsch derived liquid products and Low Aromatics Diesel Fuel. Preferably, the rapidly biodegradable hydrocarbonaceous products of the present invention are Fischer-Tropsch derived liquid products, and more preferably, are Fischer-Tropsch derived liquid products having a branching index less than five.

It has now been determined that commercial use of Fischer-Tropsch hydrocarbonaceous products and other rapidly biodegradable hydrocarbonaceous products creates an increased need for control of biological degradation. In conventional hydrocarbonaceous products, various compounds, such as aromatics, and heteroatoms, such as sulfur, nitrogen, and the like, are present. These compounds and heteroatoms tend to be natural biocides or microbial inhibitors, and thus may naturally inhibit the growth of the microbes in conventional hydrocarbonaceous products. Therefore, when using conventional hydrocarbonaceous products, the products can be shipped and stored for a period of time. However, when using hydrocarbonaceous products identified as rapidly biodegradable, it has now been determined that special measures must be taken to avoid problems resulting from rapid biodegradation during shipment and storage of these products to prevent biological degradation and microbial growth.

A product may be identified as rapidly biodegradable if visual growth of microorganisms occurs in the product in approximately ten days or less. Visual growth or formation of microorganisms may be measured quantitatively by measuring turbidity of the product in question. Turbidity is generally measured by using a turbidity meter, for example, a Hach Co. Model 2100 P Turbidimeter. A turbidity meter is a nephelometer that consists of a light source that illuminates a water/oil sample and a photoelectric cell that measures the intensity of light scattered at a 90° angle by the particles in the sample. A transmitted light detector also receives light that passes through the sample. The signal output (units in nephelometric turbidity units or NTUs) of the turbidimeter is a ratio of the two detectors. Meters can measure turbidity over a wide range from 0 to 1000 NTUs. The instrument must meet US-EPA design criteria as specified in US-EPA method 180.1.

By way of example, typical lube base oils measured at 75° F. have ranges of from 0 to 20 NTUs. Commercial Poly Alpha Olefins (PAOs) tend to have NTUs between 0 and 1. The visual formation of microorganisms is said to occur when the NTU value increases by two units from measurements made before and after microorganisms or inoculant are introduced into the sample. Measurements are made on the aqueous phase in contact with the hydrocarbon. Therefore, the NTU value of the rapidly biodegradable hydrocarbonaceous products of the present invention may show an increase of two or more units in approximately ten days or less after introduction of an inoculant.

Fischer-Tropsch Process

The majority of combustible fuel used in the world today is derived from crude oil. There are several limitations to using crude oil as a fuel source. Crude oil is in limited supply; it includes aromatic compounds that may be harmful, and contains sulfur and nitrogen-containing compounds that can adversely affect the environment, for example, by producing acid rain.

Combustible liquid fuels can also be prepared from natural gas. This preparation involves converting the natural gas, which is mostly methane, to synthesis gas, or syngas, which is a mixture of carbon monoxide and hydrogen. An advantage of using fuels prepared from syngas is that they do not contain nitrogen and sulfur and generally do not contain aromatic compounds. Accordingly, they have minimal health and environmental impact. These Fischer-Tropsch derived fuels are considered "green fuels" and are desirable as environmentally friendly.

Fischer-Tropsch chemistry is typically used to convert the syngas to a product stream that includes combustible fuel, among other products. A preferred rapidly biodegradable hydrocarbonaceous product is one derived from the Fisher-Tropsch process. A preferred Fischer-Tropsch product of the present invention has a branching index of less than five.

Fischer-Tropsch (FT) derived products include, for example, Fischer-Tropsch naphtha, Fischer-Tropsch jet fuel, Fischer-Tropsch diesel fuel, Fischer-Tropsch solvent, Fischer-Tropsch lube base stock, Fischer-Tropsch lube base oil, Fischer-Tropsch lube base oil feedstock and mixtures thereof. Distillate fuels, derived from the Fischer-Tropsch process, have excellent burning properties. Fischer-Tropsch products contain essentially no aromatics or heteroatoms, such as sulfur and nitrogen. In addition, Fischer-Tropsch distillate fuels are highly paraffinic; paraffins are the majority components (>50%) and can exceed 70% and even 95%. As a class, paraffins are the most biodegradable compounds found in petroleum and are preferentially metabolized by microbes. Alkane oxygenases are the enzymes that initiate paraffin (i.e. alkane) degradation.

In contrast to Fischer-Tropsch products, petroleum-derived or conventional hydrocarbonaceous products contain many components, and paraffins are only a minority component.

Since Fischer-Tropsch products contain essentially no natural biocides (i.e., aromatics, nitrogen, sulfur) and contain paraffins as a majority component, Fischer-Tropsch products are biodegradable. It has now been determined that Fischer-Tropsch products are also rapidly biodegradable, and therefore, are more susceptible to biodegradation during normal transport and storage than comparable petroleum fractions. The greater susceptibility for biodegradation of Fischer-Tropsch products increases the need for effective biocides during shipment and storage of these products.

Fischer-Tropsch products also tend to oxidize relatively rapidly when exposed to air. The rapid oxidation may be due to a lack of natural anti-oxidants, such as sulfur compounds.

Catalysts and conditions for performing Fischer-Tropsch synthesis are well known to those of skill in the art, and are described, for example, in EP 0 921 184 A1, the contents of which are hereby incorporated by reference in their entirety. In the Fischer-Tropsch synthesis process, liquid and gaseous hydrocarbons are formed by contacting a synthesis gas (syngas) comprising a mixture of $H_2$ and CO with a Fischer-Tropsch catalyst under suitable temperature and pressure reactive conditions. The Fischer-Tropsch reaction is typically conducted at temperatures of from about 300° to 700° F. (149° to 371° C.) preferably from about 400° to 550° F. (204° to 228° C.); pressures of from about 10 to 600 psia, (0.7 to 41 bars) preferably 30 to 300 psia, (2 to 21 bars) and catalyst space velocities of from about 100 to 10,000 cc/g/hr., preferably 300 to 3,000 cc/g/hr.

The products may range from $C_1$ to $C_{200+}$ with a majority in the $C_5$ to $C_{100+}$ range. The reaction can be conducted in a variety of reactor types, for example, fixed bed reactors containing one or more catalyst beds; slurry reactors; fluidized bed reactors; and a combination of different type reactors. Such reaction processes and reactors are well known and documented in the literature. Slurry Fischer-Tropsch processes, which are a preferred process in the practice of the invention, utilize superior heat (and mass) transfer characteristics for the strongly exothermic synthesis reaction and are able to produce relatively high molecular weight, paraffinic hydrocarbons when using a cobalt catalyst.

In a slurry process, a syngas comprising a mixture of $H_2$ and CO is bubbled up as a third phase through a slurry in a reactor which comprises a particulate Fischer-Tropsch type hydrocarbon synthesis catalyst dispersed and suspended in a slurry liquid comprising hydrocarbon products of the synthesis reaction which are liquid at the reaction conditions. The mole ratio of the hydrogen to the carbon monoxide may broadly range from about 0.5 to 4, but is more typically within the range of from about 0.7 to 2.75 and preferably from about 0.7 to 2.5. A particularly preferred Fischer-Tropsch process is taught in EP 0609079, herein incorporated by reference in its entirety.

Suitable Fischer-Tropsch catalysts comprise one or more Group VIII catalytic metals such as Fe, Ni, Co, Ru and Re. Additionally, a suitable catalyst may contain a promoter. Thus, a preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Support materials including alumina, silica, magnesia and titania or mixtures thereof may be used. Preferred supports for cobalt containing catalysts comprise titania. Useful catalysts and their preparation are known and illustrative, but non-limiting examples may be found, for example, in U.S. Pat. No. 4,568,663.

Resistance to Microbial Growth

In order to combat microbial growth and degradation of hydrocarbonaceous products, the products and/or the water layer in contact with the products may be treated with a biocide. See for example, U.S. Pat. Nos. 3,393,058 and 4,086,066. Biocides are chemical compounds that kill or inhibit the growth of microorganisms, such as for example, bacteria, molds, slimes, fungi, and the like. Biocides typically inhibit growth in hydrocarbonaceous products while being contained in the water layer. See for example U.S. Pat. No. 4,086,066.

However, the use of biocides in hydrocarbonaceous products may cause disposal and wastewater problems. Due to a biocide's potential continuing antimicrobial effects, water that contacts or contains biocides should not be discharged directly into the environment. Upon direct release into the environment, the biocide may kill or inhibit the growth of indigenous, and potentially desirable, bacterial, molds, fungi, and higher life forms. Therefore, the biocides may contaminate or pollute water supplies or require costly water treatment measures before disposal.

Further, the biocide may complicate necessary treatment of bilge water to remove residual hydrocarbons. For example, upon unloading of the hydrocarbonaceous products, the water that contacted the product may be contaminated with residual hydrocarbons. Therefore, this bilge water must be treated in on-shore facilities to remove hydrocarbons. For example, the water may be treated in a biological oxidation facility to remove residual hydrocarbons. Biocides present in the bilge water may make this treatment even more difficult and expensive. In addition, when the hydrocarbonaceous product is used for its intended purpose, residual biocide in the product may be introduced into the environment.

Therefore, there is a need for agents that are capable of inhibiting visible growth of microorganisms in rapidly biodegradable hydrocarbonaceous products that do not have the disadvantages of conventional biocides. It also important that these agents be compatible with the rapidly biodegradable hydrocarbonaceous products of the present invention.

It has now been determined that growth of microorganisms in rapidly biodegradable hydrocarbonaceous products may be inhibited by mixing the rapidly biodegradable products with an effective amount of a petroleum-derived hydrocarbonaceous product. Petroleum-derived hydrocarbonaceous products may act as an agent capable of inhibiting visible growth of microorganisms in rapidly biodegradable hydrocarbonaceous products. Therefore, to inhibit visible growth of microorganisms in rapidly biodegradable hydrocarbonaceous products, the rapidly biodegradable hydrocarbonaceous product may be mixed with an effective amount of a petroleum-derived hydrocarbonaceous product to provide a blended product.

The resulting blended product may resist visible growth of microorganisms for at least 10 days under ambient conditions when exposed to a certified inoculant. Therefore, the resulting blended product may be safely stored or transported without the use of additional conventional biocides or with the use of much lower levels of additional conventional biocides.

An effective amount of petroleum-derived hydrocarbonaceous product is the amount that inhibits microbial growth in a rapidly biodegradable hydrocarbonaceous product for approximately 10 days. The effective amount of petroleum derived hydrocarbonaceous product may vary, and thus the exact concentration of petroleum-derived hydrocarbonaceous product in the resulting blended product will also vary. Generally, the petroleum-derived hydrocarbonaceous product may be added in a concentration of approximately 10 to 90 wt %, more preferably 25 to 75 wt %. Most preferably the petroleum-derived hydrocarbonaceous product may be added in a concentration of approximately 30 to 50 wt %. It is preferable to add the petroleum-derived hydrocarbonaceous product in as low of a concentration as possible and still effectively inhibit microbial growth.

Petroleum-derived hydrocarbonaceous products are desirable agents for inhibiting growth of microorganisms in the present invention due to their high compatibility with the rapidly biodegradable hydrocarbonaceous products, including Fischer-Tropsch derived products. Petroleum-derived hydrocarbonaceous products may be highly compatible and particularly effective in inhibiting growth in the rapidly biodegradable hydrocarbonaceous products of the present invention because they reside blended in with the rapidly biodegradable hydrocarbonaceous product not as conventional biocides in the water layer.

Further, to avoid these environmental and treatment concerns, petroleum-derived hydrocarbonaceous products are preferred for use in the present invention to inhibit growth of microorganisms. When using petroleum-derived hydrocarbonaceous products to inhibit growth, the water layer may be removed and directly released or recycled without danger of environmental problems, or the water may be treated in an on-shore facility, for example a biological oxidation facility, to remove residual hydrocarbons without added expense or complications due to the biocide.

Therefore, the rapidly biodegradable hydrocarbonaceous products of the present invention may be blended with a petroleum-derived hydrocarbonaceous product during storage and/or transportation to inhibit growth of microorganisms.

Methods of Inhibiting the Growth and Reproduction of Microorganisms in Hydrocarbonaceous Products The present invention also relates to methods of inhibiting the growth and reproduction of microorganisms in rapidly biodegradable hydrocarbonaceous products containing minor amounts of aqueous liquids. In the method of the present invention, a rapidly biodegradable hydrocarbonaceous product is provided. An effective amount of petroleum-derived hydrocarbon product is added. The petroleum-derived hydrocarbon product is mixed into the rapidly biodegradable hydrocarbon product. An effective amount of petroleum-derived hydrocarbon product means that the resulting blended product is capable of resisting visible growth of microorganisms for at least 10 days under ambient conditions when exposed to a certified inoculant.

Resisting visible growth for at least 10 days means that the visual formation of microorganisms does not occur for at least 10 days. As explained previously, visual growth of microorganisms is said to occur when the NTU value increases by two units from measurements made before and after the inoculant is introduced into the sample. Therefore, resisting visual growth for at least 10 days means that the NTU value does not increase by two units. A certified inoculant consists of a source of bacteria initially isolated at ambient conditions using a rapidly biodegradable hydrocarbanaceous product standard, such as $nC_{16}$, as the sole source of carbon and energy, and that has been shown to grow on the hydrocarbanaceous product through two or more successive inoculations. Ambient conditions mean a temperature between 10 and 40° C. and a pH between 6 and 8.5.

The method may also comprise the step of processing the blended mixture to remove or at least reduce any impurities, aromatics and heteroatom (such as sulfur, nitrogen, metals) content after the period in which growth is expected.

The present invention preferably relates to a method of inhibiting the growth and reproduction of microorganisms in Fischer-Tropsch derived liquid products, preferably Fischer-Tropsch derived liquid products having a branching index of less than five. In this method of the present invention, a Fischer-Tropsch derived liquid product is synthesized in a Fischer-Tropsch synthesis process from a suitable synthesis gas. The product recovered from a Fischer-Tropsch process may range from $C_5$ to $C_{20}$+, distributed in one or more product fractions.

The products from Fischer-Tropsch reactions performed in slurry bed reactors generally include a light reaction product and a waxy reaction product. The light reaction product (i.e. the condensate fraction) includes hydrocarbons boiling below about 700° F. (e.g., tail gases through middle distillates), largely in the $C_{5-C20}$ range, with decreasing amounts up to about $C_{30}$. The waxy reaction product (i.e. the wax fraction) includes hydrocarbons boiling about 600° F.

(e.g., vacuum gas oil through heavy paraffins), largely in the $C_{20}$+ range, with decreasing amounts down to $C_{10}$. Both the light reaction product and the waxy product are substantially paraffinic. The waxy product generally comprises greater than 70% normal paraffins, and often greater than 80% normal paraffins. The light reaction product comprises paraffinic products with a significant proportion of alcohols and olefins. In some cases, the light reaction product may comprise as much as 50%, and even higher, alcohols and olefins.

The product from the Fischer-Tropsch process may be further processed using, for example, hydrocracking, hydroisomerization, hydrotreating. Such processes crack the larger synthesized molecules into fuel range and lube range molecules with more desirable boiling points, pour points, and viscosity index properties. Such processes may also saturate oxygenates and olefins to meet the particular needs of a refiner. These processes are well known in the art and do not require further description here.

To the Fischer-Tropsch derived liquid product is added an effective amount of petroleum-derived hydrocarbon product. An effective amount of petroleum-derived hydrocarbon product means that the resulting blended product is capable of resisting visible growth of microorganisms for at least 10 days under ambient conditions when exposed to a certified inoculant. The petroleum-derived hydrocarbon product is mixed into the Fischer-Tropsch derived liquid product.

A desirable property of Fischer-Tropsch products is that they contain essentially no aromatics or heteroatoms, such as sulfur and nitrogen. Therefore, Fischer-Tropsch liquid products may be used as environmentally friendly green fuels. However, the petroleum derived hydrocarbonaceous products, added to the Fischer-Tropsch products to inhibit growth of microorganisms, may add impurities, aromatics, and unwanted heteroatoms (such as sulfur and nitrogen). Therefore, the resulting blended product may contain impurities, aromatics, and unwanted heteroatoms that the original Fischer-Tropsch product did not contain.

Accordingly, after the period in which biological growth is expected and before the Fischer-Tropsch liquid products are used, it may be desirable to remove or at least reduce the impurities, aromatics, and unwanted heteroatoms (such as sulfur, nitrogen, metals). The impurities, aromatics, and heteroatom content may be reduced by a number of processes. These processes may include hydrotreating, hydrocracking, hydroisomerization, extraction, adsorption, and the like. The preferred methods are those involving processing with hydrogen (i.e., hydrotreating, hydrocracking, and hydroisomerization), with hydrotreating being the most preferred.

Hydrotreating is a process for removing impurities, such as heteroatoms (i.e. sulfur, nitrogen, oxygen) or compounds containing sulfur, nitrogen, or oxygen, from a hydrocarbon product mixture. Typical hydrotreating conditions vary over a wide range. In general, the overall LHSV (Liquid Hourly Space Velocity) is about 0.25 to 2.0 $hr^{-1}$, preferably about 0.5 to 1.0 $hr^{-1}$. The hydrogen partial pressure is greater than 200 psia, preferably ranging from about 500 psia to about 2500 psia. Hydrogen re-circulation rates are typically greater than 50 SCF/Bbl, and are preferably between 1000 and 5000 SCF/Bbl. Temperatures range from about 300° F. to about 750° F., preferably ranging from 450° F. to 600° F.

Accordingly, the methods of the present invention may also comprise the step of processing the blended mixture to remove or at least reduce any impurities, aromatics, and heteroatoms (such as sulfur, nitrogen, metals) originating from the petroleum derived product. The processing step may involve hydrotreating, hydrocracking, hydroisomerization, extraction, adsorption, and the like, preferably hydrotreating.

The branching index of a product of the present invention may be determined as follows. The total number of carbon atoms per molecule is determined. A preferred method for making this determination is to estimate the total number of carbon atoms from the molecular weight. A preferred method for determining the molecular weight is Vapor Pressure Osmometry following ASTM-2503, provided that the vapor pressure of the sample inside the Osmometer at 45° C. is less than the vapor pressure of toluene. For samples with vapor pressures greater than toluene, the molecular weight is preferably measured by benzene freezing point depression. Commercial instruments to measure molecular weight by freezing point depression are manufactured by Knauer. ASTM D2889 may be used to determine vapor pressure. Alternatively, molecular weight may be determined from a ASTM D-2887 or ASTM D-86 distillation by correlations which compare the boiling points of known n-paraffin standards.

The fraction of carbon atoms contributing to each branching type is based on the methyl resonances in the carbon NMR spectrum and uses a determination or estimation of the number of carbons per molecule. The area counts per carbon is determined by dividing the total carbon area by the number of carbons per molecule. Defining the area counts per carbon as "A", the contribution for the individual branching types is as follows, where each of the areas is divided by area A:

2-branches=half the area of methyls at 22.5 ppm/A 3-branches=either the area of 19.1 ppm or the area at 11.4 ppm (but not both)/A 4-branches=area of double peaks near 14.0 ppm/A 4+ branches=area of 19.6 ppm/A minus the 4-branches internal ethyl branches=area of 10.8 ppm/A The total branches per molecule (i.e. the branching index) is the sum of areas above.

For this determination, the NMR spectrum is acquired under the following quantitative conditions: 45 degree pulse every 10.8 seconds, decoupler gated on during 0.8 sec acquisition. A decoupler duty cycle of 7.4% has been found to be low enough to keep unequal Overhauser effects from making a difference in resonance intensity.

In a specific example, the molecular weight of a Fischer-Tropsch Diesel Fuel sample, based on the 50% point of 478° F. and the API gravity of 52.3, was calculated to be 240. For a paraffin with a chemical formula CnH2n+2, this molecular weight corresponds to an average number n of 17.

The NMR spectrum acquired as described above had the following characteristic areas:

2-branches=half the area of methyl at 22.5 ppm/A=0.30

3-branches=area of 19.1 ppm or 11.4 ppm not both/A=0.28

4-branches=area of double peaks near 14.0 ppm/A=0.32

4+ branches=area of 19.6 ppm/A minus the 4-branches=0.14 internal ethyl branches=area of 10.8 ppm/A=0.21

The branching index of this sample was found to be 1.25.

EXAMPLES

The invention will be further explained by the following illustrative examples that are intended to be non-limiting.

Example 1

Preparation of Diesel Fuel Samples

A Fischer-Tropsch product was generated by reacting synthesis gas over an iron-containing catalyst. The product was separated into a diesel boiling range product (A) and a wax. The diesel product (A) was hydrotreated to remove oxygenates and saturate olefins. The wax was hydrocracked over a sulfided catalyst consisting of amorphous silica-alumina, alumina, tungsten and nickel. A second diesel product (B) was recovered from the effluent of the hydrocracker. The two diesel products were blended in the proportion of 82% B and 18% A by weight. Properties of the Fischer-Tropsch (FT) diesel fuel blend are shown below in Table I.

TABLE I

Properties of FT Diesel Fuel

| Tests | ASTM D975 Specifications | Fischer-Tropsch Diesel |
|---|---|---|
| API Gravity, 60° F. | | 52.3 |
| Sulfur, ppm | 0.05(% mass max.) | <6 |
| Nitrogen, ng/\|M\|1 | | 0.69 |
| Cetane Index ASTM D976 | 40(min.) | 76 |
| Normal Paraffins, wt % | | 17.24 |
| Non-Paraffins, wt % | | 82.76 |
| Distillation D86, ° F. | | 333 |
| 10% | | 371 |
| 50% | | 478 |
| 90% | 540(min.), 640(max.) | 631 |
| 95% | | 653 |
| End Point | | 670 |

Samples of conventional diesel fuel (C) and California Alternate Low Aromatics Diesel Fuel (ALAD) were also obtained. Properties of these two are shown below in Table II.

TABLE II

Properties of Commercial Diesel Fuels

| Diesel Type: | C | ALAD |
|---|---|---|
| API Gravity, 60° F. | 33.9 | 36.5 |
| Sulfur, ppm | 4190 | 24 |
| Nitrogen, ppm | 296 | <1 |
| Cetane Index ASTM D976 | 46.4 | 55.0 |
| SFC Aromatics, wt % | 32.4 | 19.4 |
| D 86 Distillation, ° F. | | |
| Start | 348 | 366 |
| 5% | 385 | 448 |
| 10% | 404 | 479 |
| 30% | 470 | 535 |
| 50% | 520 | 566 |
| 70% | 568 | 593 |
| 90% | 634 | 632 |
| 95% | 661 | 652 |
| Endpoint | 685 | 671 |
| Recovery, % | 98.6 | 98.4 |

Both commercial diesel fuels contain significantly more aromatics than the Fischer-Tropsch diesel fuel, with sample C, the conventional diesel fuel, containing the most. The ALAD sample contains low levels of nitrogen and sulfur.

Example 2

Certification of the Inoculum for Determining the Speed of Biodegradation

Inoculum Development—The original alkane degrading culture was produced by growing microorganisms from a variety of sources including soils and water known to be contaminated with crude oil and petroleum products. A few micrograms of each source material were added to the minimal medium below using FT diesel as the carbon source. After substantial growth was observed, organisms were removed from the suspension by pipet and added to fresh minimal medium containing FT diesel as the carbon source. This source of organisms was used for subsequent experiments. n-$C_{16}$ could also be used as a carbon source for developing the inoculum.

To determine if the inoculum and other factors of the test, such as growth medium are suitable for use in determining the speed of biodegradation, n-$C_{16}$ was obtained from Aldrich Chemical Company, and used as a standard hydrocarbon representative of rapidly biodegradable hydrocarbonaceous products.

Growth Media—A standard minimal media containing only inorganic nutrients required for bacterial growth was used. The medium used to supply inorganic micronutrients to the growing culture of alkane degrading organisms is taking from and consists of 0.1 g/L $MgSO_4.7H_2O$, 0.5 g/L $NaNO_3$, 0.02 mM $FeSO_4$ and 0.63 g/L $K_2HPO_4$ and 0.19 g/L $KH_2PO_4$ to achieve a pH of 7 to 7.3.

Test Conditions—90 ml of media and 10 ml of the product to be tested (n-$C_{16}$) were added to 250 ml flasks. 100 $\mu$l of the bacterial inoculum was added to each flask. After inoculation, the flasks were place on a shaker-table (135 rpm) at room temperature in contact with air and observed daily.

The n-$C_{16}$ showed visual growth of microorganisms at three days in the water phase. Visual growth of microorganisms with n-$C_{16}$ under these test conditions at less then 4 days demonstrates that the inoculum is certified for determining the speed of biodegradation in this application, and that other factors in the experiment are suitable for this application.

The visual formation of microorganisms can also be measured quantitatively by measuring the turbidity. Turbidity is generally measured by using a turbidity meter, such as a Hach Co. Model 2100 P Turbidimeter. A turbidity meter is a nephelometer that consists of a light source that illuminates a water/oil sample and a photoelectric cell that measures the intensity of light scattered at a 90° angle by the particles in the sample. A transmitted light detector also receives light that passes through the sample. The signal output (units in nephelometric turbidity units or NTUS) of the turbidimeter is a ratio of the two detectors. Meters can measure turbidity over a wide range from 0 to 1000 NTUs. The instrument must meet US-EPA design criteria as specified in US-EPA method 180.1.

Typical lube base oils measured at 75° F. have ranges from 0–20 NTUs. Commercial Poly Alph Olefins (PAOs) tend to have NTUs between 0–1.

When the appearance of the oils is examined (in simulation of a customer's opinion) the following relates to the value of the NTU and the appearance:

| NTU Value | Appearance |
|---|---|
| 20 | Cloudy |
| 2–5 | Possibly acceptable, but noticeable haze |
| 0.5–2 | Clear and bright |

References drinking water must be<1.0 recreational water must be<5.0

The visual formation of microorganisms is said to occur when the NTU value increases by two units from measurements made before the microorganisms were introduced into the sample.

Example 3

Test for Rapidly Biodegradable Hydrocarbonaceous Products

The following examples identify Rapidly Biodegradable Hydrocarbonaceous Products.

Test Conditions—90 ml of media and 10 ml of the product to be tested were added to 250 ml flasks. 100 μl of the bacterial inoculum was added to each flask except for the sterile controls. The following summarizes the test conditions:

Sterile control (media boiled prior to adding product, not inoculated) Inoculated control (no inhibitor)

After inoculation, the flasks were place on a shaker-table (135 rpm) at room temperature in contact with air and observed daily. The sterile control showed no growth or discoloration.

The following Table III summarizes the appearance of visual growth in the three products tested: FT diesel fuel, ALAD Diesel, and conventional diesel.

TABLE III

| | Appearance of Visual Growth | | |
|---|---|---|---|
| Day | FT Diesel Fuel | ALAD Diesel | Conventional Diesel |
| 0 | − | − | − |
| 1 | − | − | − |
| 2 | − | − | − |
| 3 | + | + | − |
| 4 | + | + | − |
| 5 | + | + | − |
| 6 | + | + | − |
| 7 | + | + | − |
| 8 | + | + | − |

− No Growth
+ Growth (White Unless Otherwise Indicated)

Growth under ten days is representative of a product that is rapidly biodegradable because storage of products for ten days is common, and formation of a visible deposit is not acceptable. Both the FT and the ALAD samples are rapidly biodegradable under these standards while the conventional diesel fuel is not. While the specific components in the conventional diesel fuel that are responsible for resistant to biodegradation are not known, it is suspected that the higher nitrogen content of the conventional diesel fuel is at least partially responsible. Thus products have low nitrogen contents (below 100 ppm, preferably below 10 ppm) are potentially rapidly biodegradable products.

Example 4

Equivalence of n-$C_6$ and Fischer-Tropsch Diesel Fuel as Rapidly Biodegradable Hydrocarbonaceous Products To demonstrate the equivalence of n-$C_{16}$ and the Fischer-Tropsch diesel fuel, 90 ml of media and 10 ml of either FT diesel or n-$C_{16}$ was added to 250 ml flasks. 10 μl of the bacterial inoculum was added to each flask. Both showed no growth at 2 days, but 6 days (the next observation), both showed growth. The onset of growth in both materials at approximately the same time indicates that they have a nearly equivalent onset of microbial growth. Therefore, both can be used interchangeably as rapidly biodegradable hydrocarbonaceous products.

Experiment 5

Inhibition of Microbial Growth by Use of Conventional Petroleum Products

To evaluate the use of conventional petroleum products to inhibit microbial growth, a series of blends of the Fischer-Tropsch (FT) diesel fuel and the conventional (C ) diesel fuel of Experiment 1 were prepared.

For these experiments, 10:1 ratio of minimal media to the mixed feed were prepared, mixed with 10 μl of the bacterial inoculum, and evaluated in 250 ml flasks. The results of these experiments are shown in the Table IV below.

TABLE IV

| | FT Diesel Fuel Blended with Convention Diesel Fuel | | | | | | |
|---|---|---|---|---|---|---|---|
| Date | 11/1/00 | 11/2/00 | 11/6/00 | 11/7/00 | 11/9/00 | 11/13/00 | 11/20/00 |
| Time (Days) | 2 | 3 | 7 | 8 | 10 | 14 | 21 |
| 0.5% C–99.5% FT | − | − | + | + | + | + | + |
| 1% C–99% FT | − | − | + | + | + | + | + |
| 5% C–95% FT | − | − | + | + | + | + | + |
| 10% C–90% FT | − | − | + | + | + | + | + |
| 25% C–75% FT | − | − | − | − | − | − | + |
| 50% C–50% FT | − | − | − | − | − | − | − |
| FT with no C | − | − | + | + | + | + | + |
| C with no FT | − | − | − | − | − | − | − |

FT = Fischer-Tropsch diesel fuel
C = Conventional diesel fuel
− No Growth
+ Growth When more than 10% conventional fuel component is mixed with a rapidly biodegradable product, such as a Fischer-Tropsch diesel fuel, the resulting blend no longer demonstrates rapidly biodegradability. The resulting blended product can be safely stored or transported without the use of additional biocides, or with the use of lower levels of additional biocides. The resulting blend may contain sulfur, aromatics, and other impurities that originate from the conventional fuel component. These undesirable components may be removed after the period in which growth is expected. Removal may be accomplished by a number of processes, including for example, hydrotreating, hydrocracking, hydroisomerization, extraction, adsorption, and the like. The methods that involve processing with hydrogen (i.e., hydrotreating, hydrocracking and hydroisomerization) are the preferred methods of removing these impurities, with hydrotreating being the most preferred.

Various modifications and alterations of this invention will become apparent to those skilled in the art without departing from the scope and spirit of this invention.

What is claimed is:

1. A method of inhibiting growth of microorganisms in rapidly biodegradable hydrocarbonaceous products, containing minor amounts of water, comprising the steps of:

a) providing a rapidly biodegradable hydrocarbonaceous product;

b) adding an effective amount of petroleum-derived hydrocarbonaceous to resist visible growth of microorganisms for at least 10 days under ambient conditions when exposed to a certified inoculant; and c) mixing the petroleum-derived hydrocarbonaceous product into the rapidly biodegradable hydrocarbonaceous product.

2. A method according to claim 1, wherein the rapidly biodegradable hydrocarbonaceous product is selected from this group consisting of a Fischer-Tropsch derived liquid products, low aromatics diesel fuel, and mixtures thereof.

3. A method according to claim 2, wherein the Fischer-Tropsch derived liquid product has a branching index of less than five.

4. A method according to claim 1, wherein the effective amount is from 10 to 90 wt %.

5. A method according to claim 4, wherein the effective amount is from 25 to 75 wt %.

6. A method according to claim 4, wherein the effective amount is from 30 to 50 wt %.

7. A method according to claim 1, further comprising a step d) processing the mixture with hydrogen to remove sulfur and other impurities that originate from the petroleum-derived hydrocarbonaceous product after the period in which growth is expected.

8. A method of inhibiting growth and reproduction of microorganisms in Fischer-Tropsch derived liquid products, containing minor amounts of water, comprising the steps of:

a) performing a Fischer-Tropsch synthesis process;

b) isolating Fischer-Tropsch derived liquid products from the Fischer-Tropsch process;

c) adding an effective amount of petroleum-derived hydrocarbonaceous to resist visible growth of microorganisms for at least 10 days under ambient conditions when exposed to a certified inoculant; and d) mixing the petroleum-derived hydrocarbonaceous product into the Fischer-Tropsch product.

9. A method according to claim 8, wherein the effective amount is from 10 to 90 wt %.

10. A method according to claim 9, wherein the effective amount is from 25 to 75 wt %.

11. A method according to claim 9, wherein the effective amount is from 30 to 50 wt %.

12. A method according to claim 8, further comprising a step d) processing the mixture with hydrogen to remove sulfur and other impurities that originate from the petroleum-derived hydrocarbonaceous product after the period in which growth is expected.

13. A method according to claim 8, further comprising a step d) hydrotreating the mixture to remove sulfur and other impurities that originate from the petroleum-derived hydrocarbonaceous product after the period in which growth is expected.

14. A method according to claim 8, further comprising a step e) separating the aqueous phase from the hydrocarbonaceous mixture and a step f) treating the aqueous phase in a biological oxidation facility to remove hydrocarbons.

15. A method according to claim 8, wherein the Fischer-Tropsch product is selected from the group consisting of Fischer-Tropsch naphtha, Fischer-Tropsch jet fuel, Fischer-Tropsch diesel fuel, Fischer-Tropsch solvent, Fischer-Tropsch lube base stock, Fischer-Tropsch lube base oil feedstock and Fischer-Tropsch lube base oil.

16. A method according to claim 15, wherein the Fischer-Tropsch derived liquid products have a branching index of less than five.

* * * * *